US007914310B2

(12) United States Patent
Johansson et al.

(10) Patent No.: US 7,914,310 B2
(45) Date of Patent: Mar. 29, 2011

(54) UNIVERSAL SERIAL BUS CONNECTOR WITH ANTENNA CAPABILITIES

(75) Inventors: David Johansson, Malmo (SE); Markus G. Agevik, Malmo (SE); Anders Lundquist, Malmo (SE); Anders Hansson, Klagerup (SE)

(73) Assignee: Sony Ericsson Mobile Communications AB, Lund (SE)

( * ) Notice: Subject to any disclaimer, the term of this patent is extended or adjusted under 35 U.S.C. 154(b) by 790 days.

(21) Appl. No.: 11/926,836

(22) Filed: Oct. 29, 2007

(65) Prior Publication Data

US 2009/0111533 A1 Apr. 30, 2009

(51) Int. Cl.
*H01R 25/00* (2006.01)

(52) U.S. Cl. ..... 439/284; 439/660; 439/540.1

(58) Field of Classification Search ..... 439/284, 439/287, 578, 540.1, 660; 379/438, 433.05; 343/702

See application file for complete search history.

(56) References Cited

U.S. PATENT DOCUMENTS 5,584,713 A * 12/1996 Kato et al. ..... 439/188
5,812,660 A * 9/1998 Suzuki et al. ..... 379/438
6,735,308 B1 * 5/2004 Illg et al. ..... 379/438
7,163,409 B1 1/2007 Chen et al.
2003/0098817 A1 5/2003 Choi
2003/0153213 A1 8/2003 Siddiqui et al.
2004/0235355 A1 11/2004 Coniff

FOREIGN PATENT DOCUMENTS

DE 299 15 180 1/2001

OTHER PUBLICATIONS

International Search Report and Written Opinion for International Application No. PCT/IB2008/000989 dated Jul. 14, 2008.

* cited by examiner

*Primary Examiner* — Khiem Nguyen
(74) *Attorney, Agent, or Firm* — Renner, Otto, Boisselle & Sklar, LLP

(57) ABSTRACT

An electrical connector (male and female) that support conventional Universal Serial Bus (USB) signals and includes one or more additional compact coaxial connectors to enable advanced communications and/or functionality between electronic devices and/or accessory devices. In one embodiment, an electrical connector includes a contact support member housed at least partially within a housing. A plurality of first contacts are mounted on a contact support member, wherein each of the plurality of first contacts is configured to electrically connect with the associated connector along a first plane parallel to a plane of insertion for the associated connector into the port. At least one compact coaxial connector is located adjacent the housing to receive one or external antennas. The male connector includes an elastic member coupled to the one or more compact coaxial connectors, so that the male connector can be secured to a compliant female adapter and a conventional USB connector (e.g., a female USB connector not having one or more coaxial connectors positioned adjacent the housing.

20 Claims, 6 Drawing Sheets

UNIVERSAL SERIAL BUS CONNECTOR WITH ANTENNA CAPABILITIES

TECHNICAL FIELD OF THE INVENTION

The present invention relates to electrical connectors and more particularly to Universal Serial Bus (USB) connectors.

DESCRIPTION OF THE RELATED ART

Today it is commonplace for electronic equipment, such as, for example, communication devices, mobile phones, personal digital assistants, personal computers, digital video recorders, digital camcorders, digital cameras, computer peripheral devices, etc. to include a Universal Serial Bus (USB). USB is a serial bus standard to interface devices through a standardized interface port to improve plug-and-play capabilities by allowing devices to be connected and disconnected without rebooting the computer. Other convenient features associated with USB ports include powering low-consumption devices without the need for an external power supply and allowing some devices to be used without requiring individual device drivers to be installed.

The implementation of USB is generally in the form of male and female USB connectors, which are commonly employed in electronic equipment. A conventional USB female connector includes four or five signal contacts depending on the type of USB connector. The signals generally provided on a conventional USB connector include +5 Volts, Ground, Data− and Data+. If a fifth connector is provided on the USB connector, the signal contact may be used by an attached device to indicate presence of another device. In some embodiments, the fifth connector is simply not connected or held at ground depending on the specific device. Female USB connectors are typically electrically connected to a motherboard. The signal contacts of the female connector engage with the male connector, thereby transmitting signals through the cable and the mother board for communication between the motherboard and the peripheral device.

Electronic equipment have become increasingly popular and offer a wide combination of features. For example, electronic equipment may function not only as a mobile telephone, but also provide from more wireless services. In the near future there will be a substantial demand for more wireless services. Examples of such services include wireless local area network (WLAN), GPS, and DVB-H. Each of these services generally requires different external antennas for best reception. The number of pins in a system connector for electronic equipment is limited. This is especially evident in mobile devices, which are constantly trending to smaller size and/or weight. As the size of mobile devices continues to decrease, there is less space available for additional system connectors. Accordingly, there is a limit on the number of pins that may fit within the system connector.

SUMMARY

One drawback associated with conventional USB connectors is that functionality is limited based on the limited number of signal contacts (e.g., four or five) that are available for use between a device and an accessory. The amount of electronic device space that a conventional USB connector is substantial and it is beneficial to include signal contacts within the same housing and the USB connectors and/or near the USB port. The limited functionality of conventional USB connectors is insufficient to support communications with complex electronic equipment, such as mobile telephones, computers and/or other peripheral devices that provide multiple wireless services.

In view of the aforementioned shortcomings associated with conventional USB connectors, there is a need in the art for electrical connectors that support conventional USB signals and has one or more compact coaxial connectors to enable advanced communications in support of the wireless services. Such electrical connectors will provide increased functionality and, at the same time, be fully backwards compatible with conventional USB connectors.

One aspect of the invention relates an electrical connector including: an interface housing adapted to be inserted into an associated receiving female connector on an associated electronic device; wherein the housing includes at least one wall that defines a port having a predetermined configuration; a first contact support member housed at least partially within the interface housing, wherein the first contact support member extends forwardly toward the port; a plurality of first contacts mounted on the first contact support member, wherein each of the plurality of first contacts is configured to electrically connect with the associated connector and a second housing coupled to the interface housing, wherein the second housing includes at least one compact coaxial connector that is adapted to be inserted into an associated receiving female coaxial connector to provide one or more external antennas to support one or more modes of communication on the associated electronic device.

Another aspect of the invention relates to the at least one of the compact coaxial connectors being a UFL connector.

Another aspect of the invention relates to an elastic member housed at least partially within the second housing and coupled the at least one compact coaxial connector to allow the at least one compact coaxial connector to extend from and/or retract into the second housing.

Another aspect of the invention relates to the elastic member being a spring.

Another aspect of the invention relates to the plurality of first contacts include a contact for a data+signal contact, a data−signal contact, a ground signal contact and a +5 Volt signal contact.

Another aspect of the invention relates to the second housing includes one or more antenna circuits for supporting one or wireless services.

Another aspect of the invention relates to one or more of the signals received from the plurality of first contacts are used to provide power and/or control to the at least one antenna circuits.

Another aspect of the invention relates to the port being configured to receive at least universal serial bus (USB) connector having a form factor consisting of at least one of a standard USB connector, a mini-USB connector or a micro-USB connector on the associated electronic device.

Another aspect of the invention relates to the plurality of first contacts and the at least one compact coaxial connector is configured to be insertably received a single connector.

Another aspect of the invention relates to the plurality of first contact are configured to be insertably received in a first associated connector housed in the mobile device and the at least one compact coaxial connector is configured to be inserted into one or more corresponding ports formed separately in the electronic device near the port for receiving the plurality of first contacts.

Another aspect of the invention further includes at least two compact coaxial connectors, wherein the at least two compact coaxial connectors are located on opposing sides of the port.

One aspect of the invention relates to an electrical connector including: a housing for receiving an associated connector; wherein the housing includes at least one wall that defines a first port having a predetermined configuration; a plurality of first contacts housed within the housing, wherein each of the plurality of first contacts is configured to receive an associated connector, wherein the associated connector at least partially enters the housing to make electrical connection with at least one of the plurality of first contacts; and at least one second port adjacent to the housing, wherein the at least one port is configured to receive a compact coaxial connector.

Another aspect of the invention relates to at least one of the compact coaxial connectors being a UFL connector.

Another aspect of the invention relates to the first port being configured to be inserted into a universal serial bus (USB) connector having a form factor consisting of at least one of a standard USB connector, a mini-USB connector or a micro-USB connector.

Another aspect of the invention relates to the plurality of first contacts have at least one on each of the plurality of first contacts secured on a printed circuit board independently of one another.

Another aspect of the invention relates to the housing and the at least one second port being combined on a single connector.

Another aspect of the invention relates to further including at least two second ports for receiving one or more compact coaxial connectors, wherein the at least two second ports are located on opposing sides of the housing.

Another aspect of the invention relates to the at least one second port is electrically coupled to communication circuitry having a predetermined configuration.

Another aspect of the invention relates to the at least one second port being electrically coupled to detection circuitry that determines a communication mode supported by an accessory connected to the at least one port.

One aspect of the invention relates to a mobile telephone including: a housing; communication circuitry for receiving and/or transmitting telephone calls over a mobile telephony network housed within the housing; an electrical connector as described in claim 12 housed within at least a portion of the housing, wherein the first port is capable of receiving a universal serial bus connector and the second port is configured to receive a compact coaxial connector from the associated accessory; and control circuitry coupled to communication circuitry and the electrical connector to control operation of the communication circuitry and the electrical connector to perform one more functions.

To the accomplishment of the foregoing and the related ends, the invention, then, comprises the features hereinafter fully described in the specification and particularly pointed out in the claims, the following description and the annexed drawings setting forth in detail certain illustrative embodiments of the invention, these being indicative, however, of but several of the various ways in which the principles of the invention may be suitably employed.

Other systems, methods, features, and advantages of the invention will be or become apparent to one with skill in the art upon examination of the following drawings and detailed description. It is intended that all such additional systems, methods, features, and advantages be included within this description, be within the scope of the present invention, and be protected by the accompanying claims.

Although the invention is shown and described with respect to one or more embodiments, it is to be understood that equivalents and modifications will occur to others skilled in the art upon the reading and understanding of the specification. The present invention includes all such equivalents and modifications, and is limited only by the scope of the claims.

Also, although the various features are described and are illustrated in respective drawings/embodiments, it will be appreciated that features of a given drawing or embodiment may be used in one or more other drawings or embodiments of the invention.

It should be emphasized that the term "comprise/comprising" when used in this specification is taken to specify the presence of stated features, integers, steps or components but does not preclude the presence or addition of one or more other features, integers, steps, components or groups thereof."

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Likewise, elements and features depicted in one drawing may be combined with elements and features depicted in additional drawings. Moreover, in the drawings, like reference numerals designate corresponding parts throughout the several views.

DETAILED DESCRIPTION OF EMBODIMENTS

Figure 1:
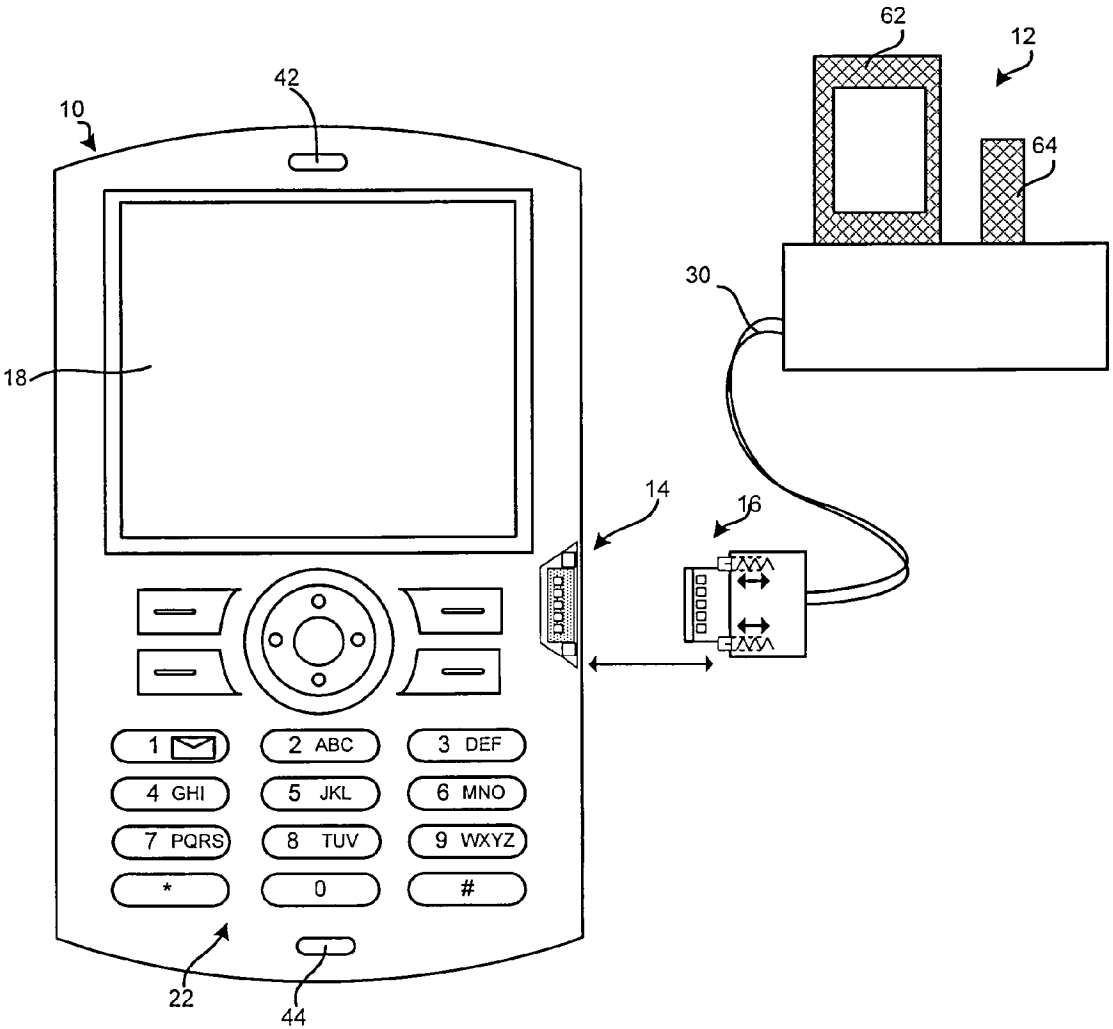
FIG. 1 is an exemplary electronic device and accessory device in accordance with aspects of the present invention.

The present invention is directed to Universal Serial Bus (USB) connectors that are suitable for use in a wide variety of electronic equipment (e.g., communication devices, mobile telephones, personal digital assistants, personal computers, digital video recorders, digital camcorders, digital cameras, computer peripheral devices, etc.). Aspects of the present invention are also directed to compact coaxial connectors (e.g., UFL connectors). Embodiments of the present invention will now be described with reference to the drawings, wherein like reference numerals are used to refer to like elements throughout. It will be understood that the figures are not necessarily to scale.

The interchangeable terms "electronic equipment" and "electronic device" include portable radio communication equipment, personal computers, digital video recorders, digital camcorders, digital cameras, computer peripheral devices, etc.). The term "portable radio communication equipment," which hereinafter is referred to as a "mobile radio terminal," includes all equipment such as mobile telephones, pagers, communicators, electronic organizers, personal digital assistants (PDAs), smart phones, portable communication apparatus, portable gaming devices, portable media devices (video and/or audio), and the like.

In the present application, embodiments of the invention are described primarily in the context of a mobile telephone. However, it will be appreciated that the invention is not intended to be limited to the context of a mobile telephone and may relate to any type of electronic equipment.

Figure 2:
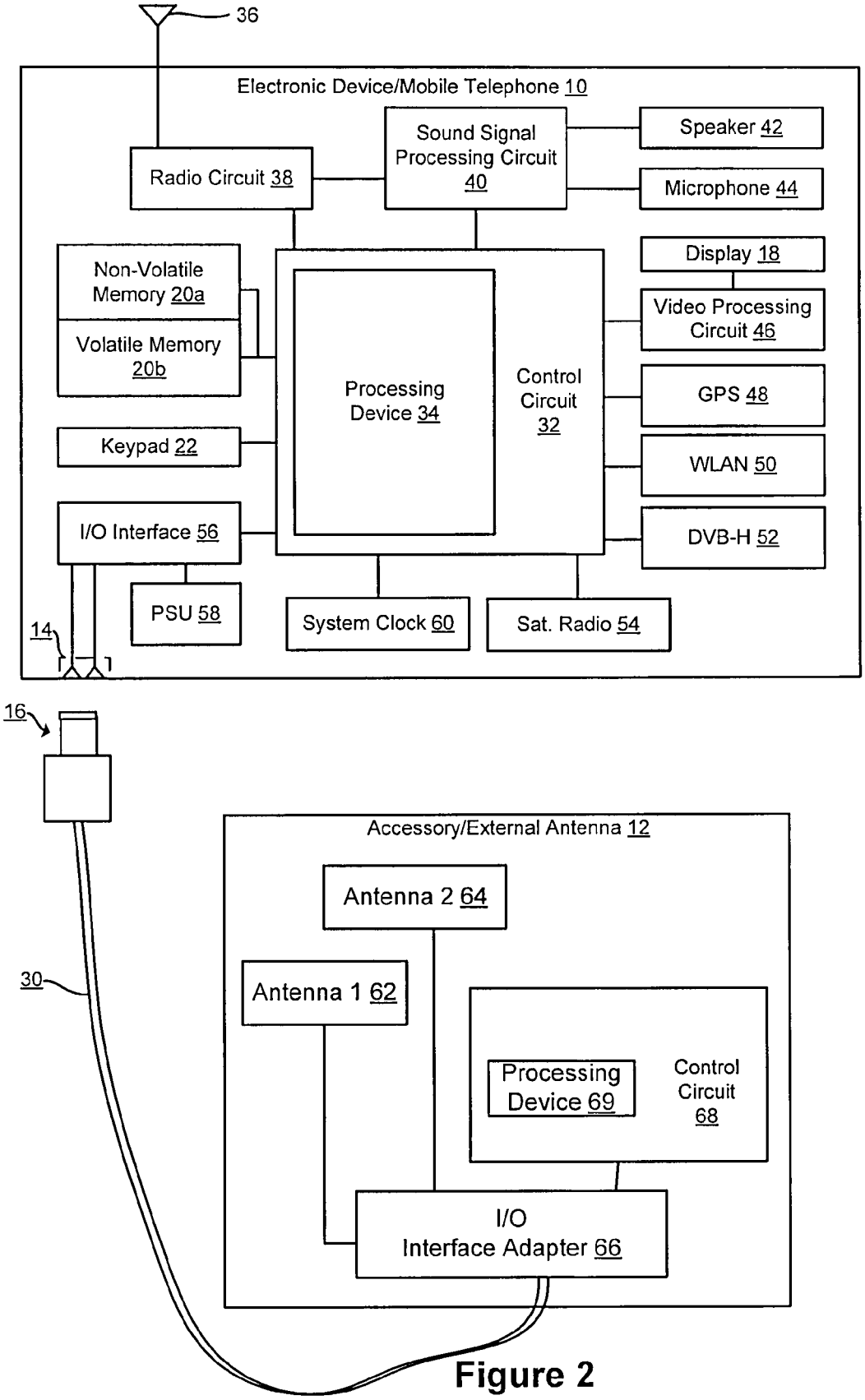
FIG. 2 is a functional block diagram of the electronic device and accessory device illustrated in FIG. 1.

Referring initially to FIGS. 1 and 2, an electronic device 10 and an accessory device 12 are shown. The electronic device 10 includes a female electrical connector 14 for receiving a male electrical connector 16 for coupling the electronic device 10 with the accessory device 12. As described more fully below, the electronic connectors 12 and 14 are configured to include one or more compact coaxial connectors on a conventional Universal Serial Bus (USB) connector in order to provide one or more external antennas that support one or more wireless communication services of the electronic device 10.

The connectors 12 and 14 generally include a plurality of first contacts, which are configured to communicate with conventional USB connectors. The connectors 12 and 14 also include at least one compact coaxial connector to provide one or more external antennas that support one or more wireless communication services for the electronic device. Generally, the first contacts are aligned together along a first contact plane that is substantially coplanar with the plane of insertion of the male connector 16 into the female connector 14, as is conventional. The one or more compact coaxial connectors are also generally aligned together along the plane of insertion of the male connector 16 into the female connector 14. As stated above, the one or more compact coaxial connectors provide one or more external antennas that support one or more communication functions of the electronic device 10. For example, it may be desirable have an external antenna for any of the following wireless services, wireless local area network (WLAN), global positioning services (GPS), digital broadcasting video-handheld (DVB-H), satellite radio, conventional AM/FM radio, etc.

The electronic device 10 of the illustrated embodiment is a mobile telephone and will be referred to as the mobile telephone 10. The mobile telephone 10 is shown as having a brick or block form factor, although other form factors, such as a "flip-open" form factor (e.g., a "clamshell" housing) or a slide-type form factor (e.g., a "slider" housing) also my be utilized.

The mobile telephone 10 may include a display 18. The display 18 displays information to a user such as operating state, time, telephone numbers, contact information, various navigational menus, etc., which enable the user to utilize the various features of the mobile telephone 10. The display 18 also may be used to visually display content received by the mobile telephone 10 and/or retrieved from a memory 20 (FIG. 2) of the mobile telephone 10. The display 18 may be used to present images, video and other graphics to the user, such as photographs, mobile television content and video associated with games.

A keypad 22 provides for a variety of user input operations. For example, the keypad 22 typically includes alphanumeric keys for allowing entry of alphanumeric information such as telephone numbers, phone lists, contact information, notes, etc. In addition, the keypad 22 typically includes special function keys such as a "call send" key for initiating or answering a call, and a "call end" key for ending or "hanging up" a call. Special function keys also may include menu navigation and select keys to facilitate navigating through a menu displayed on the display 18. For instance, a pointing device and/or navigation keys may be present to accept directional inputs from a user. Special function keys may include audiovisual content playback keys to start, stop and pause playback, skip or repeat tracks, and so forth. Other keys associated with the mobile telephone 10 may include a volume key, an audio mute key, an on/off power key, a web browser launch key, a camera key, etc. Keys or key-like functionality also may be embodied as a touch screen associated with the display 18. Also, the display 18 and keypad 22 may be used in conjunction with one another to implement soft key functionality.

The mobile telephone 10 includes call circuitry that enables the mobile telephone 10 to establish a call and/or exchange signals with a called/calling device, typically another mobile telephone or landline telephone. However, the called/calling device need not be another telephone, but may be some other device such as an Internet web server, content providing server, etc. Calls may take any suitable form. For example, the call could be a conventional call that is established over a cellular circuit-switched network or a voice over Internet Protocol (VoIP) call that is established over a packet-switched capability of a cellular network or over an alternative packet-switched network, such as WiFi (e.g., a network based on the IEEE 802.11 standard), WiMax (e.g., a network based on the IEEE 802.16 standard), etc.

The mobile telephone 10 may be configured to transmit, receive and/or process data, such as text messages (e.g., a text message is commonly referred to by some as "an SMS," which stands for short message service), instant messages, electronic mail messages, multimedia messages (e.g., a multimedia message is commonly referred to by some as "an MMS," which stands for multimedia message service), image files, video files, audio files, ring tones, streaming audio, streaming video, data feeds (including podcasts) and so forth. Processing such data may include storing the data in the memory 20, executing applications to allow user interaction with data, displaying video and/or image content associated with the data, outputting audio sounds associated with the data and so forth.

The accessory device 12 illustrated in FIGS. 1 and 2 may be any desired accessory. For example, the accessory device 12 may be one or more external antennas that may be connected to the mobile telephone through the USB connector having one or more compact coaxial connectors. Other suitable accessory devices include a headset, a keypad, a speaker, a wireless adapter (e.g., IEEE 802.11 communication adapter, infrared adapter, radio frequency identification adapter, near field communication adapter, etc.), etc. to provide increased reception for wireless to enhance the wireless services provided by the mobile telephone 10.

As stated above, aspects of the present invention relate to compact coaxial connectors. Such connectors are especially suitable for external antennas that may be connected to the mobile device 10 due to their small size and ability to be secured with a conventional interference fit. The accessory device 12 may include one or more external antennas. As shown in FIG. 1 and FIG. 2, the accessory device 12 is an external antenna that supports communications for at least two wireless communication services. As shown in FIG. 1, a cable 30 may be provided to couple the accessory device 12 to the mobile telephone 10. As explained below, the cable 30 includes an electrical connector 16 that matingly engages with electrical connector 14 of the mobile telephone 10 to accomplish the functionality described herein.

FIG. 2 represents a functional block diagram of the mobile telephone 10 and the accessory device 12. For the sake of brevity, generally conventional features of the mobile telephone 10 and the accessory device 12 will not be described in great detail herein. The mobile telephone 10 includes a primary control circuit 32 that is configured to carry out overall control of the functions and operations of the mobile telephone 10. The control circuit 32 may include a processing device 34, such as a CPU, microcontroller or microprocessor. The processing device 34 executes code stored in a memory (not shown) within the control circuit 32 and/or in a separate memory, such as the memory 20, in order to carry out operation of the mobile telephone 10.

The memory 20 may include a read only memory area that is implemented using nonvolatile memory 20*a*, and a random access or system memory area that is implemented using volatile memory 20*b*. As will be appreciated, nonvolatile memory tends not to lose data storage capability upon loss of power and is typically used to store data, application code, files and so forth. The nonvolatile memory 20*a* may be implemented with a flash memory, for example. As will be appreciated, volatile memory tends to lose data storage capability upon loss of power and is typically used to store data for access by the processing device 34 during the execution of logical routines. The volatile memory 20*b* may be a random access memory (RAM). Data may be exchanged between the nonvolatile memory 20*a* and the volatile memory 20*b* as is conventional. The nonvolatile memory 20*a* and the volatile memory 20*b* may be sized as is appropriate for the mobile telephone 10 or other electronic device in which the memory 20 is used.

Continuing to refer to FIGS. 1 and 2, the mobile telephone 10 includes an antenna 36 coupled to a radio circuit 38. The radio circuit 38 includes a radio frequency transmitter and receiver for transmitting and receiving signals via the antenna 36 as is conventional. The radio circuit 38 may be configured to operate in a mobile communications system and may be used to send and receive data and/or audiovisual content. Receiver types for interaction with a mobile radio network and/or broadcasting network include, but are not limited to, GSM, CDMA, WCDMA, GPRS, WiFi, WiMax, DVB-H, ISDB-T, etc., as well as advanced versions of these standards.

The mobile telephone 10 further includes a sound signal processing circuit 40 for processing audio signals transmitted by and received from the radio circuit 38. Coupled to the sound processing circuit 40 are a speaker 42 and a microphone 44 that enable a user to listen and speak via the mobile telephone 10 as is conventional. The radio circuit 38 and sound processing circuit 40 are each coupled to the control circuit 32 so as to carry out overall operation. Audio data may be passed from the control circuit 32 to the sound signal processing circuit 40 for playback to the user. The audio data may include, for example, audio data from an audio file stored by the memory 20 and retrieved by the control circuit 32, or received audio data such as in the form of streaming audio data from a mobile radio service. The sound processing circuit 40 may include any appropriate buffers, decoders, amplifiers and so forth.

The display 18 may be coupled to the control circuit 32 by a video processing circuit 46 that converts video data to a video signal used to drive the display 18. The video processing circuit 46 may include any appropriate buffers, decoders, video data processors and so forth. The video data may be generated by the control circuit 32, retrieved from a video file that is stored in the memory 20, derived from an incoming video data stream that is received by the radio circuit 38 or obtained by any other suitable method.

The mobile telephone 10 may also include one or more wireless adapters to perform one more corresponding wireless services. For example, the mobile telephone 10 may include a GPS adapter 48, WLAN adapter 50, DVB-H adapter 52 and/or satellite radio adapter 54. One of ordinary skill in the art will readily appreciate that mobile telephone 10 may include any adapter suitable for wireless services on a mobile telephone and/or other electronic device 10. Each of these wireless services may be connected through the electrical connector 14 to receive an external antenna (e.g., accessory device 12).

The mobile telephone 10 may further include one or more I/O interface(s) 56. The I/O interface(s) 56 may be in the form of typical mobile telephone I/O interfaces and may include one or more electrical connectors. As is typical, the I/O interface(s) 56 may be used to couple the mobile telephone 10 to a battery charger to charge a battery of a power supply unit (PSU) 58 within the mobile telephone 10. In addition, or in the alternative, the I/O interface(s) 56 may serve to connect the mobile telephone 10 to an accessory device 12 that has a wired interface with the mobile telephone 10. Further, the I/O interface(s) 56 may serve to connect the mobile telephone 10 to an accessory device, a personal computer, computer peripheral and/or any other electronic device via a data cable 30 for the exchange of data (e.g., via the electrical connector 14) and/or through a wireless adapter (not shown) that may be connected to the electrical connector 14. Additionally, the mobile telephone 10 may receive operating power via the I/O interface(s) 56 when connected to a vehicle power adapter or an electricity outlet power adapter.

The mobile telephone 10 also may include a system clock 60 for clocking the various components of the mobile telephone 10, such as the control circuit 32. The control circuit 32 may, in turn, carry out timing functions, such as timing the durations of calls, generating the content of time and date stamps, and so forth.

Referring now to the exemplary accessory device 12, the accessory device 12 includes one or more antennas (e.g., antennas 62 and 64) that are configured to modulate signals for one or more predetermined wireless services. The antennas 62, 64 may be active and/or passive antennas. The antennas 62, 64 may be coupled directly to the I/O interface adapter 66. Optionally, the antennas may be coupled to a control circuit 68 having a processing device 69 depending on the functionality of the accessory device 12. The one or more antennas 62, 64 may are receive one or more signals from the plurality of first contacts (e.g. standard USB contacts received by the connector 16, as described below. For example, an active antenna may require a power source. The current provided on a conventional USB connector may be used to power such active antenna. The input/output interface adapter 66 is generally coupled to a data cable 30 having electrical connector 16 attached on a free end for coupling to the mobile telephone 10 through electrical connector 14. The input/output interface adapter 66 generally serves to connect the accessory device 12 with the mobile telephone 10.

Figure 3:
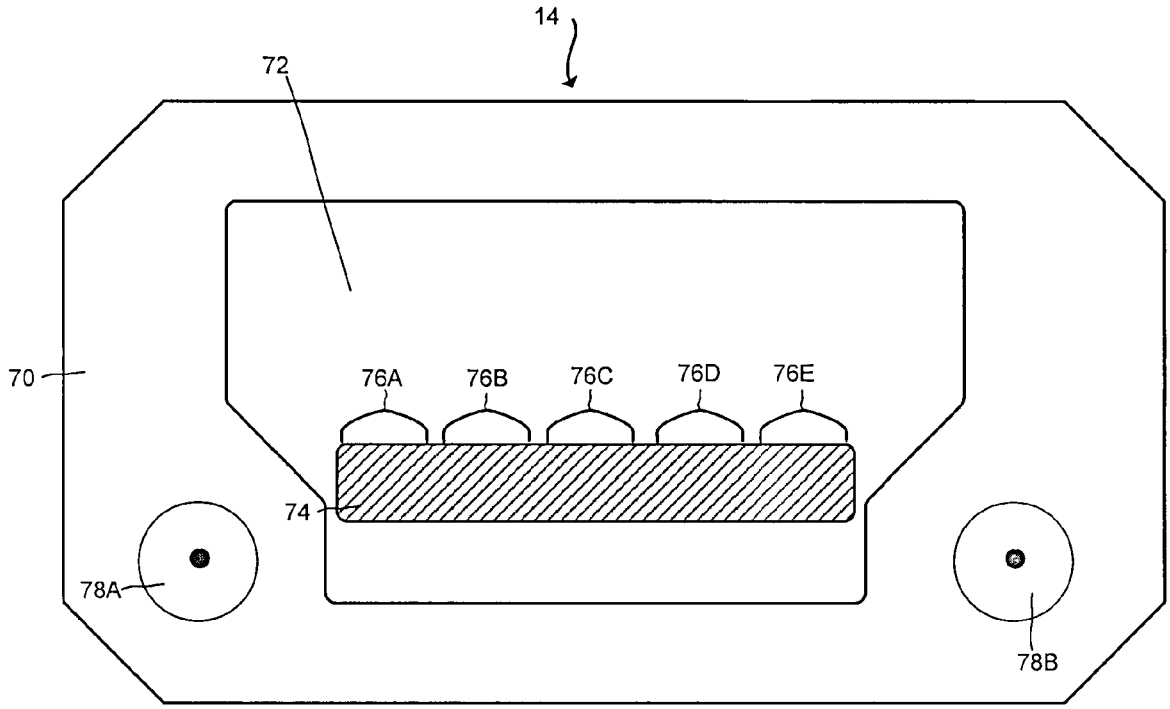
FIG. 3 is a front cross-sectional view of an exemplary female electrical connector in accordance with aspects of the present invention.
Figure 4:
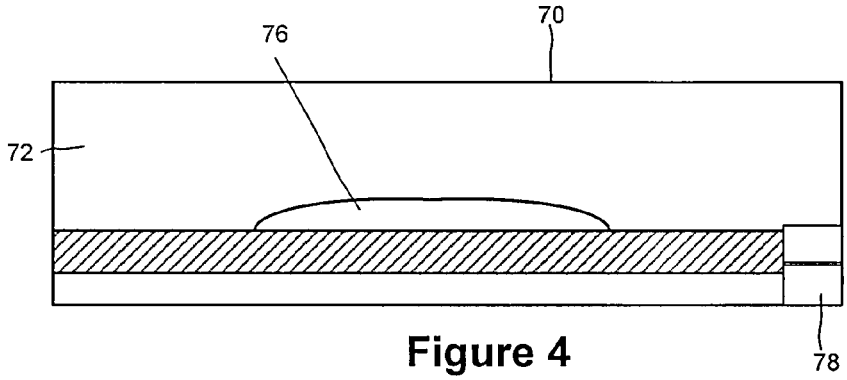
FIG. 4 is a side cross-sectional view of the exemplary female electrical connector, shown in FIG. 3.

Moving now to FIGS. 3 and 4, an exemplary electrical connector 14 in accordance with aspects of the invention is shown. The electrical connector 14 includes a housing 70 for receiving an associated connector from an accessory device. The housing is generally formed from at least one wall that defines a port 72 having a predetermined configuration. The port 72 may take any desired form. As shown in FIG. 3, the port 72 may be a standard USB form, a mini-USB form and/or a micro-USB form. The housing 70 may include one more alignment guides that generally prevent a connector not having a predetermined shape to enter into the port 72. In addition, the alignment guides ensure proper alignment of the associated connector with the electrical connector 14. The housing 70 may be made of any desirable material. Conventional housing materials include, for example, metal, plastic and the like.

The electrical connector 14 includes a contact support member 74, which is housed at least partially within the housing 70. The contact support member 74 generally extends forwardly toward the opening of the port 72. The contact support member 74 is generally made of an insulator material. Any insulator material may be used in accordance with aspects of the present invention. Exemplary insulator materials include rubber, plastic, etc.

The contact support member 74 has a plurality of first contacts 76 (e.g., 76A-76E) mounted on and/or formed in the contact support member 76. Each of the plurality of first contacts 76 is configured to electrically connect with the associated connector along a plane substantially parallel to a plane of insertion associated with the associated connector into the port 72.

The plurality of first contacts 76 is generally configured to accept conventional USB connectors (e.g., standard USB connectors, mini-USB connectors, micro-USB connectors, etc. As such, the signals generally provided on the plurality of first contacts 76 included, for example, +5 Volts on contact 76A, Data minus on contact 76B, Data plus on contact 76C, and ground on contact 76D. If a fifth contact (e.g., contact 76E) is provided on the connector, the signal contact may be used by an attached device to indicate presence of another device (e.g., mobile telephone 10). In some embodiments, the fifth connector is simply not connected or held at ground depending on the device.

As shown in FIG. 3, the plurality of first contacts 76 are provided in a linear distribution having a substantially equidistant spacing between each of the contacts. One or ordinary skill in the art will readily appreciate that the contacts may be configured and/or spaced in any desired configuration. Such configurations include, for example, non equidistant, offset, non-linear, etc.

The plurality of first contacts 76 generally extend outward from the contact support member 74 in order to engage corresponding contacts from an accessory device in order to establish signaling and/or communication paths between the mobile telephone 10 and the accessory device 12. The contacts may have any desirable shape. For example, the contacts may be curved, hemispherical, pointed, rectangular, etc.

The housing 70 includes one or more compact coaxial connector ports 78 (e.g., 78A and 78B). The one or more coaxial connector ports 78 are configured to electrically connect with associated connectors from an accessory device along an axis substantially parallel to the axis of insertion for the associated connector 16. The compact coaxial connector ports 78 may be configured to accept any desired signal that is suitable to be transmitted through a coaxial cable.

As shown in FIG. 3, the one or more coaxial connector ports 78 are generally positioned within the housing 70 and may be positioned on either side of the port 72. Due to size limitations, it is desirable to position the coaxial connector ports 78 as close as possible to the port 72. The coaxial connector ports may be positioned in any desired location within the housing 70.

Figure 5:
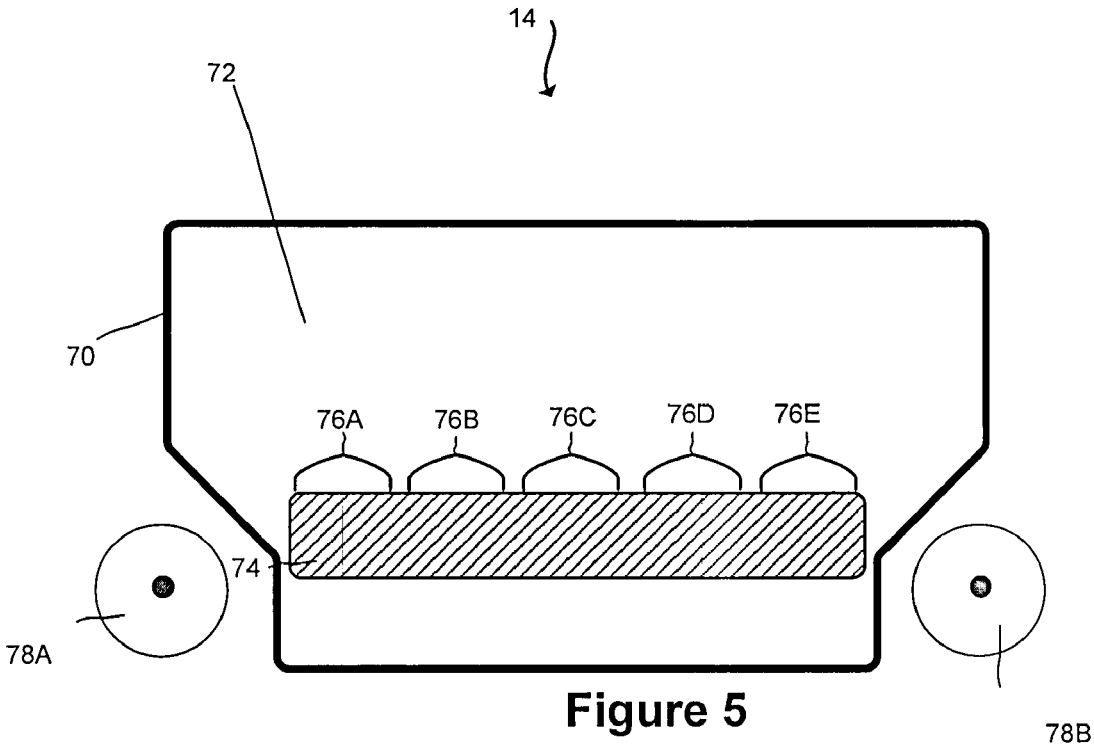
FIG. 5 is front cross-sectional view of an exemplary female electrical connector and one or more compact coaxial connectors housed near one another in accordance with aspects of the present invention.

In another embodiment, the one or more coaxial connector ports 78 may be positioned near the housing 70 and, for example, may be positioned on either side of the housing 70, as shown in FIG. 5. Due to size limitations, it is desirable to position the coaxial connector ports 78 as close as possible to the housing 70. Generally, the coaxial connector ports 78 will be positioned within two centimeters from the housing 70. The coaxial connector ports may be positioned in any desired location.

Figure 6:
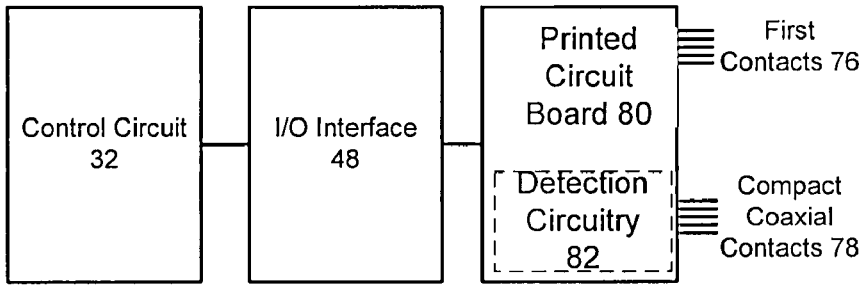
FIG. 6 is a functional block diagram in accordance with aspects of the present invention.

Referring to FIG. 6, one end of the contacts associated with the plurality of first contacts 76 are typically configured on a printed circuit board 80 electrically independent of one another. The contacts associated with the compact coaxial connectors may be configured to connect to printed circuit board and/or directly to the wireless radio circuitry in which they will support. Alternatively, there may be optional detection circuitry 82 located between the one or more coaxial connectors 78 and the wireless radio circuitry. The detection circuitry 82 may determine what type of external antenna is connected and logically connect the associated accessory 12 with the appropriate wireless radio circuitry. The printed circuit board 80 may be coupled to the input/output interface 48 that is coupled to the control circuit 32 (also referred to as a controller), as shown in FIG. 4.

Due to the configuration of the electrical connector 14, a conventional USB male connector may be matingly inserted into the port 72. The conventional USB male connector will generally engage with the plurality of first contacts 76. Since a conventional USB male connector generally does not have contacts that correspond to the one or more coaxial cable contacts, the conventional USB male connector will connect to the housing 70, as is conventional. Therefore, the electrical connector 14 is fully compatible with conventional USB connectors. Hardware designers may take advantage of this functionality by designing one mode of operation when the electrical connector 14 is connected to conventional USB connectors, as well as, a second mode of operation (having enhanced functionality) for an accessory device that is configured to include one or more compact coaxial connectors for mating with the one or more compact coaxial connectors 78.

Figure 7:
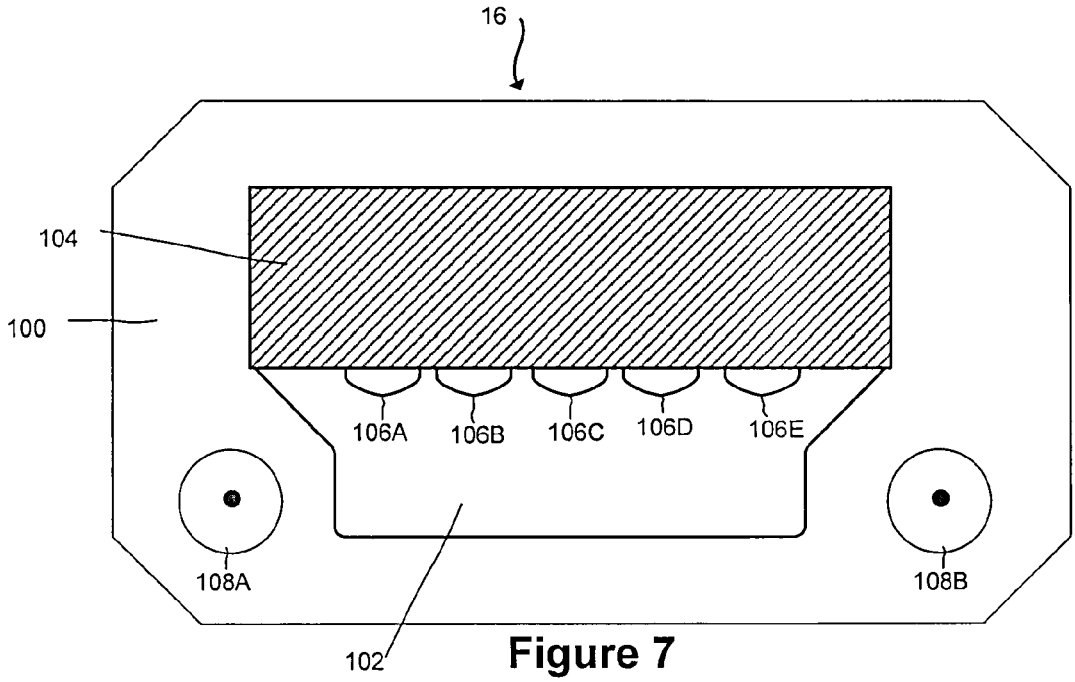
FIG. 7 is a front cross-sectional view of an exemplary male electrical connector in accordance with aspects of the present invention.
Figure 8:
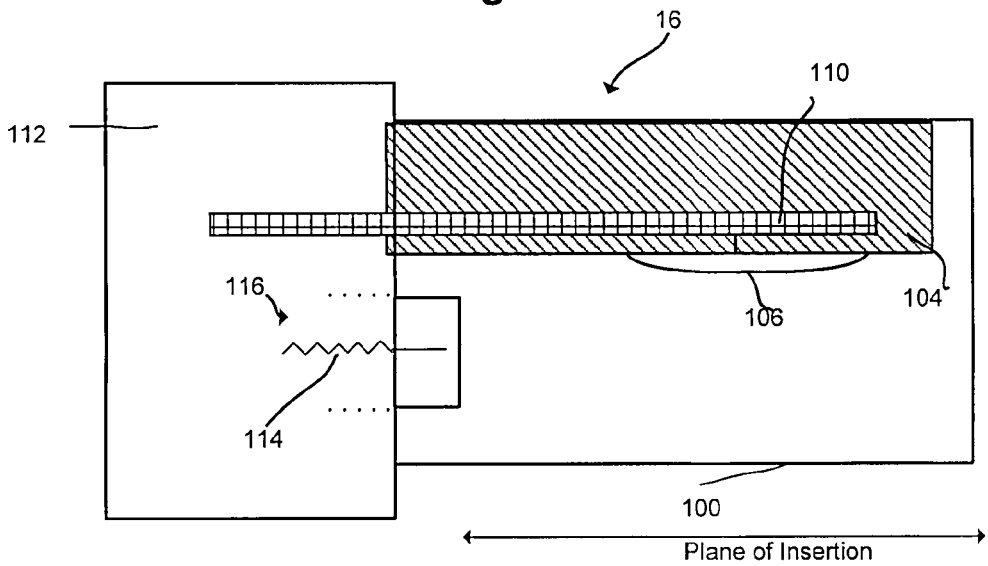
FIG. 8 is a side cross-sectional view of the exemplary male electrical connector, shown in FIG. 7.

Referring to FIGS. 7 and 8, an exemplary male electrical connector 16 is illustrated. Electrical connector 16 insertably mates with electrical connector 14 to form a secure communication link between the mobile telephone 10 and the accessory device 12.

The electrical connector 16 includes an interface housing 100 that is insertable into an associated connector 14 from an electronic device (e.g., mobile telephone 10). The interface housing 100 is generally formed from at least one wall that defines a port 102 having a predetermined configuration. The port 102 may take any desired form. As shown in FIG. 5, the port 102 may be a conventional USB port (e.g., USB-standard port, USB-mini port, USB-micro port, etc.). The port 102 is generally formed to be matingly inserted into a female connector (e.g., electrical connector 14). The interface housing 100 may include one more alignment guides that generally prevent a connector not having a predetermined shape to be inserted into a non-conforming female port. In addition, the alignment guides ensure proper alignment of the associated connector with the electrical connector 16 with a corresponding receiving port. The housing 100 may be made of any desirable material (e.g., metal, plastic etc.).

A contact support member 104 is housed at least partially within the interface housing 100, as shown in FIGS. 7 and 8. The contact support member 104 generally extends forwardly toward the opening of the port 102. The contact support member 104 is generally made of an insulator material. Any insulator material may be used in accordance with aspects of the present invention. Exemplary insulator materials include rubber, plastic, etc.

The contact support member 104 has a plurality of first contacts 106 (e.g., 106A-106E) mounted on and/or formed in the contact support member 104. Each of the plurality of first contacts 104 is configured to electrically connect with the associated connector along a plane that is substantially parallel to an axis of insertion of the interface housing 100, as illustrated in FIG. 8. The plurality of first contacts 106 is generally configured to be inserted into a conventional female USB connectors (e.g., standard USB connectors, mini-USB connectors, micro-USB connectors, etc.) depending on the form size of the housing 100. As such, the signals generally provided on the plurality of first contacts 106 include, for example, +5 Volts on contact 106A, Data minus on contact 106B, Data plus on contact 106C, and ground on contact 106D. If a fifth contact (e.g., contact 106E) is provided on the connector, the signal contact may be used by an attached device to indicate presence of another device (e.g., mobile telephone 10). In some embodiments, the fifth connector is simply not connected or held at ground depending on the device. Additional contacts may be provided adjacent the plurality of first contacts 106.

As shown in FIGS. 7 and 8, the electrical connector 16 includes one or more compact coaxial connectors 108. A second housing 112 coupled to the interface housing 100 includes at least one compact coaxial connector 108 that is adapted to be inserted into an associated receiving connector (e.g., compact coaxial connector 78) to provide one or more external antennas to support one or more modes of communication on the associated mobile device. Like the plurality of first contacts 106, the one or more compact coaxial connectors 108 are configured to electrically connect with the associated compact coaxial connector along a plane that is substantially parallel to an axis of insertion of the interface housing 100. Thus, one electrical connector 16 may be used to connect the plurality of first contacts and the one or more compact coaxial connectors to the mobile telephone 10. The single electrical connector 16 may be used to connect the plurality of first contacts and the one or more compact coaxial connectors to the mobile telephone 10 as long as there are corresponding ports in the mobile device 10, regardless if the ports are in a single connector or combined in the housing of the mobile device and the port 72.

As is conventional, the plurality of first contacts 106 are provided in a linear distribution having a substantially equidistant spacing between each of the contacts. One or ordinary skill in the art will readily appreciate that the contacts may be configured and/or spaced in any desired configuration. Such configurations include, for example, non-equidistant, offset, non-linear, etc. The plurality of first contacts 106 generally extend outward from the contact support member 104 in order to engage corresponding contacts from a female connector, such as electrical connector 14 in order to establish signaling and/or communication paths between the mobile telephone 10 and the accessory device 12. The contacts may have any desirable shape. For example, the contacts may be curved, hemispherical, pointed, rectangular, etc.

The electrical connector 16 includes a second housing 112 coupled to the interface housing 100. The second housing 112 includes at least one compact coaxial connector 108 that is adapted to be inserted into an associated receiving connector 78 to provide one or more external antennas to support one or more modes of communication on the associated mobile device. The at least compact coaxial connector 108 is configured to be electrically connected with the associated connector 78 along a plane that is substantially parallel to the plane of insertion of the interface housing into a corresponding electrical connector 14.

The one or more compact coaxial connectors 108 may be configured to accept any desirable signal available within the mobile telephone 10 and transmit any desired signal from the accessory device 12 to the mobile telephone 10 (or other electronic devices). For example, one or more of the compact coaxial connectors 108 may receive additional power signals from electrical connector 14 to provide power to an active antenna. In addition, the one or more compact coaxial connectors 108 may provide one or external antennas to support functionality of a particular accessory device. Thus, the one or more compact coaxial connectors 108 may cooperate with one or more second contacts 78 on the mobile telephone to provide additional functionality to the mobile telephone 10. Such functionality includes, for example, providing one or more external antennas in the accessory device 12 to enhance wireless communication services.

Referring to FIGS. 7 and 8, the plurality of first contacts 106 may be distributed on a face of the contact support member 104, as is conventional. The one or more compact coaxial connectors may be secured in a second housing 112 coupled to the interface housing 100. The second housing 112 includes at least one compact coaxial connector 108 that is adapted to be inserted into an associated receiving connector 78 to provide one or more external antennas to support one or more modes of communication on the associated mobile device, as discussed above. For example, the one or more compact coaxial connectors 108 may be secured to the second housing 112 or any other structure contained within the electrical connector 16. The plurality of first contacts 106 and the one or more compact coaxial connectors 108 contacts are oriented substantially parallel to each other in order that they may be easily inserted by pushing into the female connector 14 and/or removed by pulling the male connector 16 out of the female connector 14. Generally, the plurality of first contacts 106 are configured to make electrical contact with corresponding first contacts 76 in the electrical connector 14 when inserted in port 72. Likewise, the one or more compact coaxial connectors 108 are configured to make electrical contact with the one or more compact coaxial connectors 78 in the electrical connector 14 when the electrical connector 16 is inserted into port 72, which requires compact coaxial connectors 108 to enter corresponding female compact coaxial connectors 78.

As shown in FIG. 7, the one or more compact coaxial connectors 108 (e.g., 108A-108B) are provided in a linear distribution on either side of the port 72. One or ordinary skill in the art will readily appreciate that the one or more compact coaxial connectors 108 may be configured and/or spaced in any desired configuration.

Figure 9:
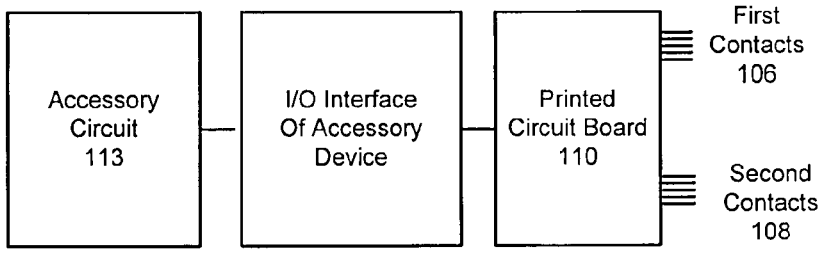
FIG. 9 is a functional block diagram in accordance with aspects of the present invention.

Referring to FIG. 9, the contacts associated with the plurality of first contacts 106 and the one or more compact coaxial connectors 108 generally have at least one end secured on a printed circuit board 110 electrically independent of one another. The printed circuit board 110 may be coupled to the accessory circuitry 113 that makes use and/or otherwise manipulates the signals received through the plurality of first contacts 106 and/or the second contacts 108 to provide the desired functionality of the accessory device 12. In addition, the accessory circuitry 113 generally includes one or more antenna circuitry that may extend the transmission and/or reception coverage area of the accessory device 12 and/or one more wireless services available on the mobile telephone 10.

Referring to FIG. 8, the one or more compact coaxial connectors 108 may include an elastic member 114 (e.g., a spring, coil, etc.) coupled between compact coaxial connectors 108 and the second housing 112 and/or the printed circuit board 110. The elastic member 114 exerts a force on the one or more compact coaxial connectors to urge contact with a corresponding compact coaxial connector 78 from an associated female connector (e.g., electrical connector 14) and/or a combination of the mobile device 10 and the electrical connector 14. Also, the elastic member 114 allows for the one or more compact coaxial connectors 108 to retreat within a socket 116 formed in the housing 112 when the electric connector 16 is inserted into a female connector that does not include corresponding compact coaxial contacts and/or ports to received the one or more compact coaxial connectors 108. This allows the electrical connector 16 to be inserted into a conventional USB female connector (e.g., a standard USB connector, a mini-USB connector, a micro-USB connector, etc.) without the one or more compact coaxial connector contacts 108 interfering and/or otherwise hindering securement of the connectors.

When inserted into the conventional USB female connector, the one or more compact coaxial connectors 108 will retreat into the housing 100 and not interfere with insertion of the electrical connector 16 into the conventional USB female connector. When inserted into the conventional USB female connector, the electrical connector 16 will generally engage with the conventional USB contacts of the USB female connector. This allows the electrical connector 16 to be fully compatible with conventional USB connectors. Hardware designers may be able to advantage of this by monitoring whether or not the one or more compact coaxial connectors 108 retreat into the housing. If the one or more compact coaxial connectors retreat into the housing, it is known that the electrical connector 16 was plugged in to a conventional USB connector, accordingly less functionality and/or capabilities of the accessory device 12 can be expected and/or less reception may be expected when the accessory device includes an antenna. Likewise, if the one or more compact coaxial connectors are extended, then the compact coaxial connectors are engaged in an enhanced electrical connector (e.g., electrical connector 14) and the accessory device 12 may make use of the full functionality and/or capabilities of the accessory device.

Figure 10:
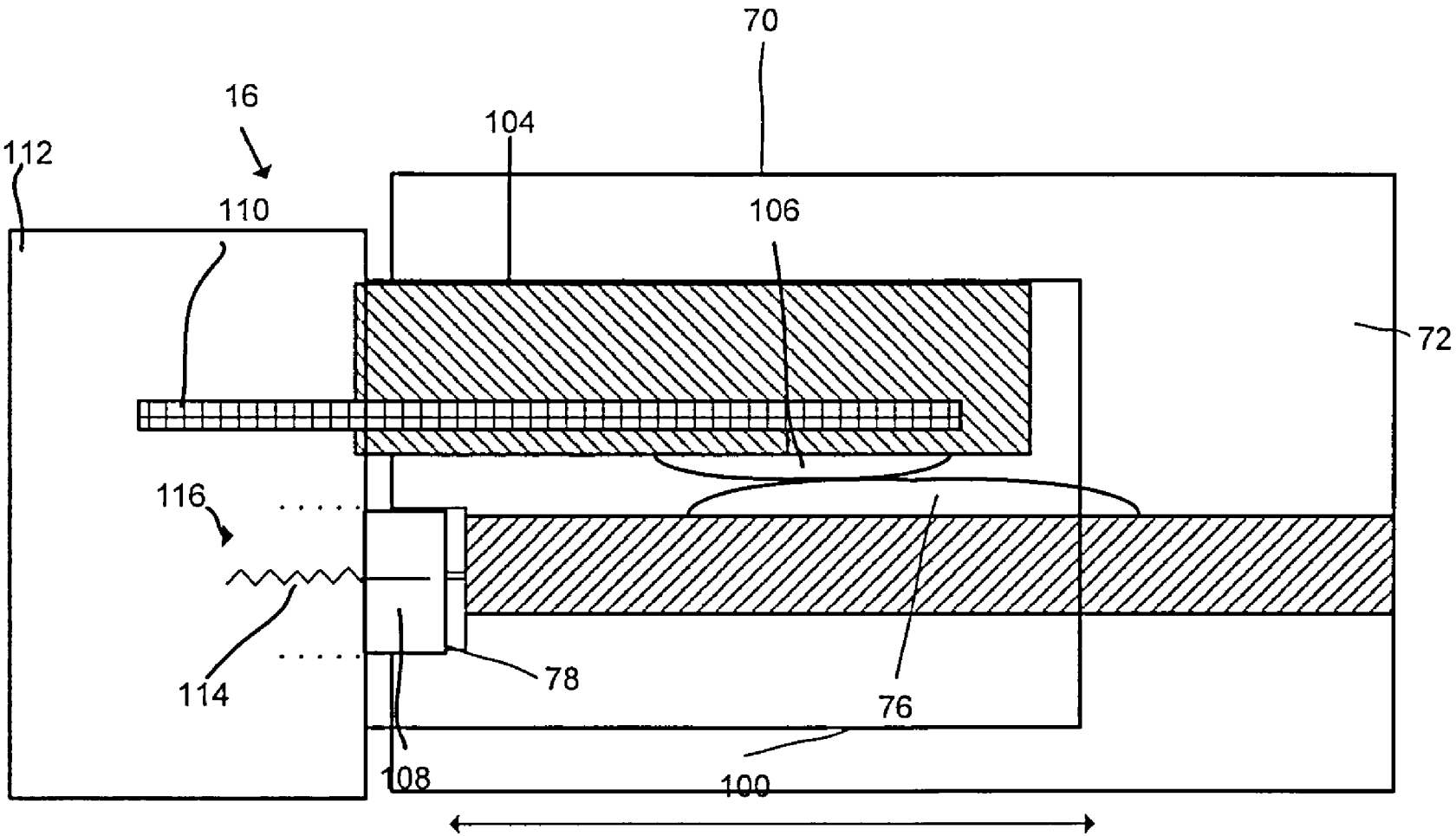
FIG. 10 is a side cross-sectional view of exemplary male and female electrical connectors electrically connected in accordance with aspects of the present invention.

Referring to FIG. 10, female electrical connector 14 is shown electrically engaged with male connector 16. As shown, the first contacts 76 and 106 engage along a first contact plane that is substantially parallel with a plane of insertion. Second contacts 78 and 108 engage along a plane that is substantially parallel to the first plane and/or the plane of insertion.

Referring back to FIG. 1, an exemplary cable 30 is illustrated having a male electrical connector 16. One of ordinary skill in the art will appreciate that the cable 30 may have two free ends that include identical connectors and/or connectors that have the same functionality, but different form factors (e.g., a standard USB, mini-USB, micro-USB, etc.). Generally the male 16 will include the one or more compact coaxial connectors attached on each free end of the cable 30.

Specific embodiments of the invention have been disclosed herein. One of ordinary skill in the art will readily recognize that the invention may have other applications in other environments. In fact, many embodiments and implementations are possible. The following claims are in no way intended to limit the scope of the present invention to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means".

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An electrical connector comprising:

an interface housing adapted to be inserted into an associated receiving female connector on an associated electronic device, wherein the housing includes at least one wall that defines a port having a predetermined configuration;

a first contact support member housed at least partially within the interface housing, wherein the first contact support member extends forwardly toward the port;

a plurality of first contacts mounted on the first contact support member, wherein each of the plurality of first contacts is configured to electrically connect with the associated connector when inserted along a plane of insertion into the associated receiving female connector and a second housing coupled to the interface housing, wherein the second housing includes at least one compact coaxial connector that is adapted to be inserted into an associated receiving female coaxial connector when inserted along the plane of insertion to provide one or more external antennas to support one or more modes of communication on the associated electronic device.

2. The electronic connector of claim 1, wherein at least one of the compact coaxial connectors is a UFL connector.

3. The electrical connector of claim 1 further including an elastic member housed at least partially within the second housing and coupled the at least one compact coaxial connector to allow the at least one compact coaxial connector to extend from and/or retract into the second housing.

4. The electrical connector of claim 3, wherein the elastic member is a spring.

5. The electrical connector of claim 1, wherein the plurality of first contacts include a contact for a data+signal contact, a data−signal contact, a ground signal contact and a +5 Volt signal contact.

6. The electrical connector of claim 1, wherein the second housing includes one or more antenna circuits for supporting one or wireless services.

7. The electrical connector of claim 6, wherein one or more of the signals received from the plurality of first contacts are used to provide power and/or control to the at least one antenna circuits.

8. The electrical connector of claim 1, wherein the port is configured to receive at least universal serial bus (USB) connector having a form factor consisting of at least one of a standard USB connector, a mini-USB connector or a micro-USB connector on the associated electronic device.

9. The electrical connector of claim 8, wherein the plurality of first contacts and the at least one compact coaxial connector is configured to be insertably received a single connector.

10. The electrical connector of claim 8, wherein the plurality of first contact are configured to be insertably received in a first associated connector housed in the mobile device and the at least one compact coaxial connector is configured to be inserted into one or more corresponding ports formed separately in the electronic device near the port for receiving the plurality of first contacts.

11. The electrical connector of claim 8 further including at least two compact coaxial connectors, wherein the at least two compact coaxial connectors are located on opposing sides of the port.

12. An electrical connector comprising:

a housing for receiving an associated connector; wherein the housing includes at least one wall that defines a first port having a predetermined configuration;

a plurality of first contacts housed within the housing, wherein each of the plurality of first contacts is configured to receive an associated connector, wherein the associated connector at least partially enters the housing to make electrical connection with at least one of the plurality of first contacts; and at least one second port adjacent to the housing, wherein the at least one port is configured to receive a compact coaxial connector.

13. The electronic connector of claim 12, wherein at least one of the compact coaxial connectors is a UFL connector.

14. The electrical connector of claim 12, wherein the first port is configured to be inserted into a universal serial bus (USB) connector having a form factor consisting of at least one of a standard USB connector, a mini-USB connector or a micro-USB connector.

15. The electrical connector of claim 13, wherein the plurality of first contacts have at least one on each of the plurality of first contacts secured on a printed circuit board independently of one another.

16. The electrical connector of claim 13, wherein the housing and the at least one second port is combined on a single connector.

17. The electrical connector of claim 16 further including at least two second ports for receiving one or more compact coaxial connectors, wherein the at least two second ports are located on opposing sides of the housing.

18. The electrical connector of claim 16, wherein the at least one second port is electrically coupled to communication circuitry having a predetermined configuration.

19. The electrical connector of claim 12, wherein the at least one second port is electrically coupled to detection circuitry that determines a communication mode supported by an accessory connected to the at least one port.

20. A mobile telephone comprising:

a housing;

communication circuitry for receiving and/or transmitting telephone calls over a mobile telephony network housed within the housing;

an electrical connector as described in claim 12 housed within at least a portion of the housing, wherein the first port is capable of receiving a universal serial bus connector and the second port is configured to receive a compact coaxial connector from the associated accessory; and control circuitry coupled to communication circuitry and the electrical connector to control operation of the communication circuitry and the electrical connector to perform one more functions.

* * * * *